US006656654B2

(12) United States Patent
Higuchi et al.

(10) Patent No.: US 6,656,654 B2
(45) Date of Patent: Dec. 2, 2003

(54) TONER AND TWO-COMPONENT DEVELOPER, CONTAINER THEREFOR, AND IMAGE FORMING APPARATUS

(75) Inventors: Hiroto Higuchi, Shizuoka (JP); Masanori Suzuki, Shizuoka (JP); Hiroaki Matsuda, Shizuoka (JP); Akemi Sugiyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/820,609

(22) Filed: Mar. 30, 2001

(65) Prior Publication Data

US 2002/0001766 A1 Jan. 3, 2002

(30) Foreign Application Priority Data

Mar. 31, 2000 (JP) ..... 2000-097743

(51) Int. Cl.[7] ..... G03G 9/097; G03G 9/087

(52) U.S. Cl. ..... 430/108.3; 430/108.4; 430/109.3; 430/109.4; 430/110.3

(58) Field of Search ..... 430/109.4, 109.3, 430/108.3, 108.4, 110.3; 399/252

(56) References Cited

U.S. PATENT DOCUMENTS

| | | | | | |
|---|---|---|---|---|---|
| 5,079,123 | A | * | 1/1992 | Nanya et al. | 430/109.4 |
| 5,756,244 | A | * | 5/1998 | Omatsu et al. | 430/109.4 |
| 5,990,332 | A | * | 11/1999 | Sukata et al. | 430/108.3 |
| 6,022,661 | A | * | 2/2000 | Kurose et al. | 430/110.3 |
| 6,077,635 | A | * | 6/2000 | Okado et al. | 430/110.3 |
| 6,218,065 | B1 | * | 4/2001 | Tanikawa et al. | 430/108.3 |
| 6,232,027 | B1 | * | 5/2001 | Matsunaga et al. | 430/109.4 |
| 6,232,030 | B1 | * | 5/2001 | Otani et al. | 430/137.2 |
| 6,238,836 | B1 | * | 5/2001 | Nakamura et al. | 430/108.21 |
| 6,335,137 | B1 | * | 1/2002 | Suzuki et al. | 430/120 |
| 6,337,957 | B1 | | 1/2002 | Tamaki et al. | 399/29 |
| 6,403,275 | B1 | | 6/2002 | Kuramoto et al. | 430/111.4 |
| 6,442,364 | B2 | | 8/2002 | Kai et al. | 399/277 |
| 6,468,706 | B2 | | 10/2002 | Matsuda et al. | 430/108.6 |
| 6,505,014 | B2 | | 1/2003 | Aoki et al. | 399/55 |
| 6,507,718 | B2 | | 1/2003 | Ohjimi et al. | 399/127 |

FOREIGN PATENT DOCUMENTS

EP 0255925 * 2/1988

OTHER PUBLICATIONS

Diamond, A.S., ed. *Handbook of Imaging Materials*, Marcel Dekker, Inc., NY (1991), pp 160–163.*
Diamond, A.S, ed *Handbook of Imaging Materials*, Marcel Dekker, Inc, NY (1991), pp 165–168.*
Morrison, R.T, & R.N. Boyd, *Organic Chemistry*, Allyn & Bacon, Inc, Boston (1965), pp 184–186.*
Claims, Figs only 09/656,414, filed Sep. 6, 2000.
Claims, Figs only 09/565,539, filed May 5, 2000.
Claims, Figs only 09/567,982, filed May 10, 2000.
Claims, Figs only 09/820,609, filed Mar. 30, 2001.
Claims, Figs only 09/873,246, filed Jun. 5, 2001.
Claims, Figs only 09/905,872, filed Jul. 17, 2001.
Claims, Figs only 09/943,505, filed Aug. 31, 2001.
Claims, Figs only 09/944,076, filed Sep. 4, 2001.
Claims, Figs only 09/953,922, filed Sep. 18, 2001.
Claims, Figs only 09/982,877, filed Oct. 22, 2001.
Claims, Figs only 09/963,429, filed Sep. 27, 2001.
Claims, Figs only 09/996,585, filed Nov. 30, 2001.
Claims, Figs only 10/041,582, filed Jan. 10, 2002.
Claims, Figs only 10/077,813, filed Feb. 20, 2002.
Claims, Figs only 10/077,752, filed Feb. 20, 2002.
Claims, Figs only 10/083,159, filed Feb. 27, 2002.
Claims, Figs only 10/086,683, filed Mar. 4, 2002.
Claims, Figs only 10/098,591, filed Mar. 18, 2002.
Claims, Figs only 10/151,103, filed May 21, 2002.
Claims, Figs only 10/155,111, filed May 28, 2002.
Claims, Figs only 10/285,636, filed Nov. 1, 2002.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A toner for developing electrostatic latent images contains a coloring agent, a release agent, a binder resin including a non-linear polyester resin with a hydroxyl number of 30 to 70 mgKOH/g, and a metallic compound of an aromatic oxycarboxylic acid with a central metal having a valence of 3 or more. The toner is used in combination with a carrier to prepare a two-component developer. The toner or two-component developer is held in a container. The present invention further provides an image forming apparatus equipped with the container that holds therein the above-mentioned toner or two-component developer.

42 Claims, No Drawings

TONER AND TWO-COMPONENT DEVELOPER, CONTAINER THEREFOR, AND IMAGE FORMING APPARATUS

BACKGROUND OF THE INVENTION

1. Field of the Invention

The present invention relates to a toner and a two-component developer for use with an image forming process such as an electrophotographic process or electrostatic printing process. The present invention also relates to a container filled with the above-mentioned toner or two-component developer, and an image forming apparatus equipped with the aforementioned container.

2. Discussion of Background

Various electrophotographic image forming methods are described, for instance, in U.S. Pat. No. 2,297,691 and Japanese Patent Publications No. 49-23910 and No. 43-24748. Generally, in such image forming methods, latent electrostatic images are formed on the surface of a photoconductor by making use of the characteristics of a photoconductive material employed in the photoconductor. The latent electrostatic images are then developed with a toner to obtain visible toner images, which are transferred to a transfer sheet such as a sheet of paper when necessary and fixed thereon by the application of heat and/or pressure, or a vapor of a solvent. Image-bearing copies are thus made.

The methods of developing the latent electrostatic images can be roughly classified into two methods.

One method is a liquid development method which uses a liquid developer prepared by finely dispersing various kinds of pigments or dyes in an electrical insulating organic solvent.

The other method is a dry development method in which a dry toner comprising a natural or synthetic resin and a coloring agent such as carbon black dispersed in the resin is employed. More specifically, the dry development method includes cascade development, magnetic brush development, powder cloud development, and the like. The dry development method has been widely adapted in recent years.

For fixing the toner images on the transfer sheet, a heat roller image fixing method is in general use because of its excellent energy efficiency. By this image fixing method, a heat roller is directly brought into pressure contact with a toner image deposited on the transfer sheet.

In consideration of the environmental protection from the viewpoint of energy saving, there is a demand for reduction in the electric consumption necessary for the heat roller to complete the image fixing operation. Various improvements in an image fixing unit have been made to satisfy the above-mentioned demand. For instance, it is proposed to reduce the thickness of a heat roller which comes in contact with the toner image. This proposal shows a noticeable improvement in heat energy efficiency and a drastic curtailment of time required to raise the temperature of the heat roller to a predetermined temperature. However, in this case, the specific heat capacity of the heat roller becomes so small that the temperature on the surface of the heat roller largely varies depending on whether a portion of the heat roller passes through a transfer sheet or not. Thus, a toner image on the transfer sheet is melted by the contact with a heated portion of the roller and the melted toner readily adheres to the surface of the image fixing roller. The melted toner adhering to the heat roller is again transferred back to a non-image portion of the transfer sheet while the heat roller is rotating over the transfer sheet. The so-called hot-offset phenomenon occurs in this manner. The requirements for toner have become more severe in order to prevent the occurrence of the above-mentioned hot-offset phenomenon.

In recent years, there is a tendency that the thermal energy applied to the toner images at the image fixing step becomes smaller to achieve image fixing at lower temperatures in light of energy saving or to accomplish high-speed copying operation. To cope with the image fixing at lower temperatures, various resins and waxes with low softening points have been adapted in the preparation of toner compositions.

The addition of a wax as a release agent to the toner composition or the use of a polyester resin which can be fixed at lower temperatures has been investigated to satisfy both the low-temperature image fixing and anti-hot-offset performance. For example, a toner comprising two kinds of linear polyester resins is disclosed in Japanese Laid-Open Patent Applications 63-225244, 63-225245, and 63-225246. However, this toner cannot apply to a wide-range of image forming process speeds, that is, from a low speed to a high speed. Further, toner compositions disclosed in Japanese Laid-Open Patent Applications 3-188468 and 9-204071 comprise polyester resins, of which the acid value, hydroxyl number, molecular weight distribution, or tetrahydrofuran-insoluble content is specified. However, further improvement is required in order to satisfy all the requirements, that is, the low-temperature image fixing performance, anti-hot-offset performance, and blocking resistance.

To solve the above-mentioned problems, it is proposed that a chelate compound having salicylic acid or oxysalicylic acid as a ligand be used as a charge control agent for use in a toner composition. Japanese Laid-Open Patent Application 62-145255 and Japanese Patent Publication 55-42752 disclose metal complex salts of salicylic acid derivatives as the charge control agents. However, those metal complexes may produce environmental problems because they have heavy metals such as chromium (Cr) and cobalt (Co).

In consideration of environment, investigation of a salicylic acid derivative having as a central metal iron (Fe) instead of the above-mentioned heavy metal such as chromium (Cr) has been proceeding. Japanese Laid-Open Patent Application 1-309072 describes that the effect can be obtained only when a metal complex of a salicylic acid derivative having carboxyl group or sulfoxyl group as a substituent is used as the charge control agent.

A toner composition disclosed in Japanese Laid-Open Patent Application 9-325520, of which thermal characteristics are specified, comprises a resin with a specific structure and an organic metallic compound. In this application, the valence number of the employed metal for use in the metallic compound is not particularly limited. Even though this toner is employed for image formation, the effect of preventing the hot-offset phenomenon is still unsatisfactory.

Japanese Laid-Open Patent Applications 7-230188 and 10-10785 exhibit an effect obtained only by the combination of a specific resin and an iron complex compound having an oxycarboxylic acid as a ligand.

According to the above-mentioned applications, an effect can be exhibited only when an iron complex compound of salicylic acid having a specific structure is employed in a toner composition, or the combination of a particular resin and an iron complex of salicylic acid is used in a toner composition. According to the above-mentioned applications, it is unclear whether such an effect can be obtained or not unless the substituent for the iron complex compound of salicylic acid is limited to carboxyl group or sulfoxyl group, or unless the structure of the resin to be used together with the iron complex of salicylic acid is specifically limited. It is impossible to expect the dispersion properties in a resin and the charging characteristics of a charge control agent in the form of a metal complex compound so long as the ligand of the metal complex is different.

In recent years, there is a tendency for the toner particle size to decrease in line with the demand for high quality copy image. A decrease in particle size of toner causes various problems although the toner image quality is improved. In the image fixing step, the fixing properties of toner particles become poor, in particular, at a halftone portion. This is because the deposition amount of toner is small at the halftone portion, and some fine toner particles deposited on the halftone portion, lying on a depression of a transfer sheet, tends to cause an offset phenomenon. Namely, the heat energy provided by an image fixing roller is extremely small.

SUMMARY OF THE INVENTION

Accordingly, a first object of the present invention is to provide a toner for producing high quality image, of which charging characteristics can sharply rise and remain stable regardless of the change in environmental conditions, and of which anti-hot-offset performance is excellent, and in addition, resistance to low-temperature offset phenomenon (hereinafter referred to as anti-cold-offset performance) is also excellent, capable of exhibiting high productivity and heat-resistant shelf stability.

A second object of the present invention is to provide a two-component developer using the above-mentioned toner.

A third object of the present invention is to provide a container for holding therein the above-mentioned toner.

A fourth object of the present invention is to provide a container for holding therein the above-mentioned two-component developer.

A fifth object of the present invention is to provide an image forming apparatus equipped with the container holding therein the above-mentioned toner.

A sixth object of the present invention is to provide an image forming apparatus equipped with the container holding therein the above-mentioned two-component developer.

The first object of the present invention can be achieved by a toner for developing electrostatic latent images comprising a coloring agent, a release agent, a binder resin which comprises a non-linear polyester resin with a hydroxyl number of 30 to 70 mgKOH/g, and a metallic compound of an aromatic oxycarboxylic acid with a central metal having a valence of 3 or more.

The second object of the present invention can be achieved by a two-component developer comprising the above-mentioned toner and a carrier.

The third object of the present invention can be achieved by a container holding therein the above-mentioned toner.

The fourth object of the present invention can be achieved by a container holding therein the above-mentioned two-component developer.

The fifth object of the present invention can be achieved by an image forming apparatus equipped with the container that holds therein the above-mentioned toner.

The sixth object of the present invention can be achieved by an image forming apparatus equipped with the container that holds therein the above-mentioned two-component developer.

DESCRIPTION OF THE PREFERRED EMBODIMENTS

A toner of the present invention comprises a non-linear polyester resin with a hydroxyl number of 30 to 70 mgKOH/g as a binder resin component. A metallic compound of an aromatic oxycarboxylic acid with a central metal having a valence of 3 or more is contained in the toner composition. The hydroxyl groups of the non-linear polyester resin can form a loose cross-linking structure with the metallic compound of aromatic oxycarboxylic acid. Such a three-dimensional cross-linking structure has the effect of preventing the hot-offset phenomenon. In particular, even when a small-sized transfer sheet passes through an image fixing thin-walled roller and a large-sized transfer sheet follows later, the hot-offset phenomenon can be effectively prevented from occurring at both edge portions of the large-sized transfer sheet. This effect cannot be exhibited when a bivalent metal is used as the central metal of the metallic compound of aromatic oxycarboxylic acid.

In the toner of the present invention, it is preferable that the amount of the metallic compound of oxycarboxylic acid be in the range of 0.1 to 10 parts by weight, and more preferably in the range of 0.1 to 5 parts by weight, with respect to 100 parts by weight of the binder resin.

When the hydroxyl number of the non-linear polyester resin is less than 30 mgKOH/g, anti-hot-offset performance is insufficient. When the hydroxyl number of the non-linear polyester resin exceeds 70 mgKOH/g, environmental stability in the charging characteristics of the obtained toner is poor although the anti-hot-offset performance becomes sufficient.

When the metallic compound of oxycarboxylic acid has iron (Fe) as the central metal, the charging performance can rise sharply. When the central metal of the above-mentioned metallic compound is zirconium (Zr), the color of the obtained metallic compound is white, so that the metallic compound is suitable for a color toner.

It is preferable that the release agent for use in the toner of the present invention comprise a carnauba wax free of free aliphatic acids. In this case, the toner exhibits excellent release properties, and further improved anti-hot-offset performance at the image fixing step.

In the toner of the present invention, the binder resin may further comprises a linear polyester resin and a composite resin of a polyester resin and a vinyl resin, the composite resin being prepared by parallel reaction of (1) a condensation polymerization of a condensation-polymerizable monomer to prepare the polyester resin, (2) an addition polymerization of an addition-polymerizable monomer to prepare the vinyl resin in the same reactor. When the binder resin for use in the toner comprises the non-linear polyester resin, linear polyester resin, and composite resin of a polyester resin and a vinyl resin, as mentioned above, the linear polyester resin can contribute to the anti-cold-offset performance, whereby the offset phenomenon can be prevented throughout a wide temperature range. Further, the above-mentioned composite resin can be finely dispersed in the non-linear polyester resin and the linear polyester resin. In other words, the composite resin can work to bind the non-linear polyester resin and the linear polyester resin together. This makes it possible to improve the productivity of toner and the heat-resistant shelf stability of the obtained toner.

It is preferable that the molecular weight distribution of the toner exhibit at least one peak within the range of 1,000 to 10,000 when the molecular weight distribution is measured by gel permeation chromatography (GPC) from a content soluble in tetrahydrofuran (THF). At the same time, it is preferable that the half peak width in the molecular weight distribution be 15,000 or less. The molecular weight distribution of the toner is practically determined by that of the binder resin contained in the toner. When the binder resin exhibits such a molecular weight distribution as mentioned above, the resistance to cold-offset phenomenon can improve more noticeably than ever.

The measurement of GPC is carried out in the following manner. A column is fixed in a heated chamber of 40° C., and tetrahydrofuran (THF) serving as a solvent is caused to pass through the column at a flow rate of one milliliter per minute at 40° C. 50 to 200 microliter of a THF solution containing 0.05 to 0.6 wt. % of a sample resin is injected into the column. The molecular weight distribution of the sample resin is determined by calculation based on the relationship between a logarithmic value and a count number read from a calibration curve. The calibration curve is obtained by plotting the logarithmic values and the count numbers of several kinds of monodisperse polystyrene standard samples. For calibration, the following polystyrene standard samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are available from, for example, Pressure Chemical Co., or Tosoh Corporation, can be used. It is proper to use at least about ten standard polystyrene samples for preparing the calibration curve. A refractive index detector is used for the measurement.

It is preferable that the toner of the present invention comprise toner particles with a volume mean diameter of 4 to 8 $\mu$m. In such a case, thin line images can be faithfully reproduced, thereby obtaining high image quality. When the volume mean diameter of the toner particles is less than 4 $\mu$m, the cleaning properties of the obtained toner is unsatisfactory, which induces a problem of poor durability, although the reproducibility of thin line images is satisfactory.

The volume mean diameter of toner particles can be measured by various methods. In the present invention, measuring apparatus used is "COULTER COUNTER MODEL TA-II" (trademark), available from Coulter Electronics Inc., to which an interface for outputting a number base distribution and a volume base distribution (available from Nikkaki K.K.) and a personal computer "PC9801" (available from NEC Corp.) are attached. For measurement, a 1% aqueous solution containing a first class grade sodium chloride is prepared as an electrolytic solution. A surfactant, preferably an alkylbenzenesulfonate, is added as a dispersant in an amount of 0.1 to 5 ml to 50 to 100 ml of the above-mentioned electrolytic solution, and a sample toner weighing 1 to 10 mg is added thereto. The electrolytic solution containing the sample toner is subjected to dispersion treatment for one minute using an ultrasonic dispersion apparatus. The thus prepared dispersion of the sample toner is added to 100 to 200 ml of an electrolytic aqueous solution, which is separately prepared in a beaker, until a predetermined concentration can be obtained. Using the above-mentioned measuring "COULTER COUNTER MODEL TA-II" with an aperture of 100 $\mu$m, the particle size distribution of sample toner particles in a number of 30,000 particles with a particle size of 2 to 40 $\mu$m is measured on a number basis. The volume base distribution and the number base distribution of the toner particles ranging from 2 to 40 $\mu$m are calculated, to obtain a volume mean diameter on a weight basis determined from the volume base distribution. In this measurement, a center value in each channel is regarded as a representative value of the channel.

It is preferable that the toner particles have an average circularity of 0.940 or more. In this case, satisfactory line images can be reproduced because non-transferred spots in the line images can be effectively reduced. The average circularity of 0.940 or more means sufficiently high surface smoothness of the toner particle. The number of contact points of a toner particle having high surface smoothness with the photoconductor is decreased, so that such a toner particle can smoothly transfer from the photoconductor to an image receiving sheet. The result is that line images can be reproduced on the sheet without any non-image transferred spots in the form of worm-eaten spots.

The average circularity of the toner is measured with a commercially available flow particle image analyzer "FPIA-1000" (trademark), made by Sysmex Corporation. The above-mentioned analyzer and the measuring method are described in Japanese Laid-Open Patent Application 8-136439. For the measurement, a 1% aqueous solution containing a first class grade sodium chloride is prepared and filtered through a 0.45-$\mu$m filter. A surfactant, preferably an alkylbenzenesulfonate, is added as a dispersant in an amount of 0.1 to 5 ml to 50 to 100 ml of the above-mentioned aqueous solution of sodium chloride. A sample toner weighing 1 to 10 mg is added to the aqueous solution. This dispersion of the sample toner is subjected to dispersion treatment for one minute using an ultrasonic dispersion apparatus. The concentration of the toner particles in the dispersion is adjusted to 5,000 to 150,000 particles per microliter. From the area of a two-dimensional image of a particle taken by a CCD camera, a projected area diameter is obtained as an equivalent circle diameter. In light of the accuracy of picture elements of the CCD, the equivalent circle diameter of 0.6 $\mu$m or more is regarded as effective for measurement of the average circularity. After the circularity of each particle is calculated, the average circularity is obtained from the total number of particles. The circularity of each particle is determined in such a manner that the perimeter of a circle having the same area as the projected area is divided by the perimeter of the projected image of the particle. In the case where the circularity of a particle is less than 0.4, the circularity is recognized as 0.4. The smaller the circularity of a toner particle, the more complex the projected image of the toner particle and the higher the surface roughness of the toner particle.

The method for preparing a toner of the present invention is not particularly limited. The toner particles can be obtained by a conventional pulverizing method, or other methods such as a polymerization method. Or the above-mentioned methods may be used in combination.

The polyester resin for use in the present invention is a polymer obtained by condensation polymerization of a polyhydroxy compound and a polybasic acid.

Specific examples of the polyhydroxy compound include glycols such as ethylene glycol, diethylene glycol, triethylene glycol, and propylene glycol; alicyclic compounds having two hydroxyl groups such as 1,4-bis(hydroxymethyl) cyclohexane; and dihydric phenols such as bisphenol A. The polyhydroxy compound also includes compounds having three or more hydroxyl groups.

Specific examples of the polybasic acid are dicarboxylic acids such as maleic acid, fumaric acid, phthalic acid, isophthalic acid, terephthalic acid, succinic acid, and malonic acid; and polycarboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In view of the heat-resistant shelf stability of the obtained toner, it is preferable that the polyester resin for use in the present invention have a glass transition temperature (Tg) of 55° C. or more, and more preferably 60° C. or more.

In the condensation polymerization reaction between the polyhydroxy compound and the polybasic acid, it depends upon the kinds of raw materials whether the obtained polyester resin has a nonlinear structure or a linear structure. The non-linear polyester resin thus prepared in the present invention, which forms a cross-linking structure, has an effect on the anti-hot-offset performance. On the other hand, the linear polyester resin thus prepared is provided with no cross-linking structure in practice, and has the effect of preventing the cold-offset phenomenon.

The hydroxyl number of the non-linear polyester resin for use in the toner is in the range of 30 to 70 mgKOH/g. A non-linear polyester resin provided with a desired hydroxyl number can be obtained by appropriately controlling the conditions in the esterification reaction. The hydroxyl number is measured by a method as prescribed in Japanese Industrial Standard (JIS) K 0070. If a resin sample is not dissolved in the course of the measurement, a solvent such as dioxane or tetrahydrofuran may be employed.

As mentioned above, the molecular weight distribution of the toner is practically determined by the binder resin because the amount of binder resin is most large in the toner composition. To obtain a desired molecular weight distribution of the binder resin, the degree of polymerization may be controlled by choosing proper monomers and adjusting the reaction time of the condensation polymerization.

Preferably, the composite resin of a polyester resin and a vinyl resin for use in the present invention is prepared by parallel reaction of the condensation polymerization and the addition polymerization in the same reactor. The raw material for preparation of a condensation polymerization polymer, that is, the polyester resin, is not particularly limited so long as a polyester resin can be obtained. The above-mentioned raw materials for the polyester resin can be employed.

On the other hand, as the addition-polymerizable monomer to prepare the vinyl resin, there can be employed various monomers capable of producing vinyl resins by radical polymerization, but those monomers are not particularly limited.

Specific examples of the monomer subjected to the addition polymerization for the preparation of the vinyl resin are styrene, o-methylstyrene, m-methylstyrene, p-methylstyrene, α-methylstyrene, p-ethylstyrene, vinylnaphthalene, ethylenic unsaturated monoolefins such as ethylene, propylene, butylene, and isobutylene, vinyl esters such as vinyl chloride, vinyl bromide, vinyl acetate, and vinyl formate, ethylenic monocarboxylic acids and esters thereof, such as acrylic acid, methyl acrylate, ethyl acrylate, n-propyl acrylate, isopropyl acrylate, tert-butyl acrylate, amyl acrylate, methacrylic acid, methyl methacrylate, ethyl methacrylate, n-propyl methacrylate, isopropyl methacrylate, tert-butyl methacrylate, amyl methacrylate, stearyl methacrylate, methoxyethyl methacrylate, glycidyl methacrylate, phenyl methacrylate, dimethylaminoethyl methacrylate, and diethylaminoethyl methacrylate, ethylenic monocarboxylic acid substitution products such as acrylonitrile, methacrylonitrile, and acrylamide, ethylenic dicarboxylic acid substitution products such as dimethyl maleate, and vinyl ketones such as vinyl methyl ketone.

When necessary, a cross-linking agent may be employed in the addition polymerization to prepare the vinyl resin. Specific examples of the cross-linking agent for the addition-polymerizable monomers are divinylbenzene, divinylnaphthalene, polyethylene glycol dimethacrylate, diethylene glycol dimethacrylate, triethylene glycol diacrylate, dipropylene glycol dimethacrylate, polypropylene glycol dimethacrylate, and diallyl phthalate.

It is preferable that the amount of the cross-linking agent be in the range of 0.05 to 15 parts by weight, and more preferably in the range of 0.1 to 10 parts by weight, with respect to 100 parts by weight of the addition-polymerizable monomers. When the amount of the cross-linking agent is within the above range, the effect of the cross-linking agent can be exhibited, and the obtained toner can readily be melted by the application of heat thereto, so that the image fixing properties of the toner in the thermal image fixing step are satisfactory.

A polymerization initiator may be used in the course of the addition polymerization of the addition-polymerizable monomers.

Examples of the polymerization initiator used in the addition polymerization include azo- or diazo-based polymerization initiators, such as 2,2'-azobis(2,4-dimethylvaleronitrile) and 2,2'-azobisisobutyronitrile; and peroxide polymerization initiators such as benzoyl peroxide, methyl ethyl ketone peroxide, and 2,4-dichlorobenzoyl peroxide.

Two or more kinds of polymerization initiators may be used together to control the molecular weight and the molecular weight distribution of the obtained polymer. It is preferable that the amount of the polymerization initiator be in the range of 0.05 to 15 parts by weight, and more preferably in the range of 0.5 to 10 parts by weight, with respect to 100 parts by weight of the addition-polymerizable monomers.

In the present invention, the composite resin of a polyester resin and a vinyl resin can be obtained by causing a condensation polymerization and an addition polymerization in the same reactor. In other words, the composite resin can be obtained in such a fashion that the condensation polymerization resin, i.e., the polyester resin, and the addition polymerization resin, i.e., the vinyl resin are chemically bonded to each other.

In view of this point, it is advantageous to use a compound that is reactive to both the condensation-polymerizable monomer and the addition-polymerizable monomer in the same reactor in the course of the preparation of the composite resin by the condensation polymerization and the addition polymerization. For example, fumaric acid, acrylic acid, methacrylic acid, maleic acid, and dimethyl fumarate can be used as the above-mentioned monomer that is reactive to both kinds of polymerizable monomers. It is preferable that such a monomer reactive to both polymerizable monomers be employed in an amount of 2 to 20 parts by weight, more preferably 3 to 10 parts by weight, with respect to 100 parts by weight of the addition-polymerizable monomer. When the monomer reactive to both polymerizable monomers is contained in such an amount as mentioned above, a coloring agent and a charge control agent can be sufficiently dispersed in the obtained binder resin. As a result, a decrease in image quality caused by toner deposition on the background or the like can be prevented. At the same time, gelation of the resin can be inhibited.

In the parallel reaction for producing the composite resin, the condensation polymerization may not always proceed in parallel with the addition polymerization, and both polymerization reactions may not terminate simultaneously. By separately controlling the reaction temperature and the reaction time, the condensation polymerization and the addition polymerization may be independently carried out. For instance, a mixture of an addition-polymerizable monomer (monomer for preparation of a vinyl resin) and a polymerization initiator is added dropwise to a mixture of condensation-polymerizable monomers (monomers for preparation of a polyester resin), thereby mixing all the raw materials together in advance in the same reaction vessel. The polymerization reaction for the preparation of a vinyl resin by a radical reaction is first completed. Subsequently, with an increase in reaction temperature, the rest polymerization reaction, that is, a condensation reaction is caused to produce a polyester resin. By allowing the two kinds of polymerization reactions to independently proceed in the same reaction vessel, the obtained polyester resin and vinyl resin can be effectively dispersed with each other.

For the purpose of improving the productivity of toner, any other resins may be used in combination with the non-linear polyester resin, or in addition to the non-linear polyester resin, the linear polyester resin, and the composite resin so as not to impair the properties of the obtained toner. Namely, a polyurethane resin, silicone resin, ketone resin, petroleum resin, and hydrogenated petroleum resin may be used alone or in combination to be added to the polyester resin for use in the present invention.

The preparation method of the above-mentioned resins is not particularly limited, but may also include bulk polymerization, emulsion polymerization, and suspension polymerization.

The metallic compound of oxycarboxylic acid is present in the produced toner in such a fashion that the metallic compound and the non-linear polyester resin serving as the binder resin form a cross-linking structure. The metallic compound of oxycarboxylic acid for use in the present invention is represented by the following formula (1) or (2):

(1)

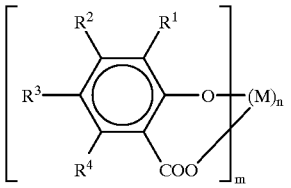

wherein $R^1$, $R^2$, $R^3$, and $R^4$ are each a hydrogen atom, an alkyl group having 1 to 18 carbon atoms, or an aryl group, $R^1$, $R^2$, $R^3$, and $R^4$ may be the same at the same time or different, and $R^1$ and $R^2$, $R^2$ and $R^3$, or $R^3$ and $R^4$ may independently form an aromatic ring which may have a substituent or an aliphatic ring which may have a substituent; M is a metal; m is an integer of 3 or more; and n is an integer of 2 or more.

(2)

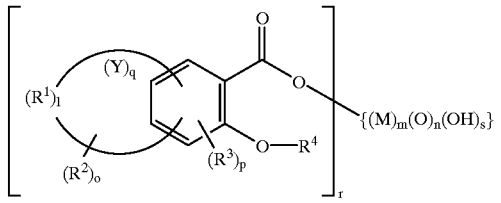

wherein Y represents a cyclic structure of saturated or unsaturated bond; $R^1$, which represents a moiety included in the cyclic structure of Y, is a quaternary carbon, methine, or methylene, and $R^1$ may include a hetero atom such as N, S, O, or P; $R^2$ and $R^3$ are each independently an alkyl group, an alkenyl group, an alkoxyl group, a substituted or unsubstituted aryl group, a substituted or unsubstituted aryloxy group, a substituted or unsubstituted aralkyl group, a substituted or unsubstituted aralkyloxy group, a halogen atom, a hydrogen atom, hydroxyl group, a substituted or unsubstituted amino group, carboxyl group, carbonyl group, nitro group, nitroso group, sulfonyl group, or cyano group; $R^4$ is a hydrogen atom or an alkyl group; l is an integer of 0, or 3 to 12; m is an integer of 1 to 20; n is an integer of 0 to 20; o is an integer of 0 to 4; p is an integer of 0 to 4; q is an integer of 0 to 3; r is an integer of 1 to 20; s is an integer of 0 to 20; and M is a metal having a valence of 3 or more.

As the central metal represented by M in formula (1) or (2) of the above-mentioned metallic compound, any metals having a valence of 3 or more can be used. In particular, Fe, Ni, Al, Ti, and Zr are preferable, and Fe is most preferable from the viewpoint of safety to human body.

The toner of the present invention comprises a coloring agent. Any coloring agents conventionally used in the toner can be used in the present invention. For example, carbon black, Aniline Black, furnace black, and lamp black can be used as a black coloring agent; Phthalocyanine Blue, Methylene Blue, Victoria Blue, Methyl Violet, Aniline Blue, and ultramarine blue, as a cyan coloring agent; Rhodamine 6G Lake, dimethyl quinacridone, Watchung Red, Rose Bengale, Rhodamine B, and alizarin lake, as a magenta coloring agent; and chrome yellow, Benzidine Yellow, HANSA Yellow, Naphthol Yellow, molybdenum, orange, Quinoline Yellow, and Tartrazine, as a yellow coloring agent.

The toner of the present invention comprises a release agent. Examples of the release agent include montan wax, oxidized rice bran wax, solid silicone wax, higher fatty acid, higher alcohol, and low-molecular weight polypropylene wax. These waxes may be used alone or in combination.

In particular, when a carnauba wax free of free aliphatic acids is used as the release agent, preferable results can be obtained. The polyester resin reacts with a highly reactive portion of the above-mentioned carnauba wax to form a loose cross-linking structure. Namely, the above-mentioned carnauba wax is considered to produce the effect of improving the anti-hot-offset performance. With respect to the carnauba wax, it is preferable that the carnauba wax be in a microcrystalline state with an acid value of 5 or less. Further, when the carnauba wax is dispersed in the binder resin, it is preferable that the particles of carnauba wax have a particle diameter of 1 $\mu$m or less.

It is preferable that the amount of release agent be in the range of 1 to 20 parts by weight, and more preferably in the range of 3 to 10 parts by weight, with respect to 100 parts by weight of the binder resin for use in the toner composition.

Before the release agent is dispersed in the binder resin, it is preferable that the release agent have a volume mean diameter of 10 to 800 μm. When the volume mean diameter of the release agent is less than 10 μm, sufficient release properties cannot be obtained when the release agent is dispersed in the binder resin. This will induce the offset problem. When the volume mean diameter of the release agent exceeds 800 μm, too many particles of the release agent are present in the surface portion of the obtained toner particles. The result is that the fluidity of toner particles is lowered and the toner particles tend to stick to the inner walls of the development unit unfavorably. The particle size of the release agent is measured with a commercially available analytical instrument "PARTICLE SIZE DISTRIBUTION ANALYZER LA-920" (trademark), made by Horiba Ltd.

The metallic compound of aromatic oxycarboxylic acid for use in the toner of the present invention can serve as a charge control agent. Any other conventional charge control agents may be used together. As a negative charge control agent, a fluorine-containing quaternary ammonium salt, a metallic salt of monoazo dye, a metal complex of naphthoic acid, and a metal complex of dicarboxylic acid can be employed. In particular, when the metallic salt of a monoazo dye is added as a charge control agent to the toner composition, occurrence of fogging can be effectively reduced, thereby producing high quality images for an extended period of time.

The toner of the present invention can be used as a magnetic toner by addition of a magnetic material.

Examples of the magnetic material used for preparation of the magnetic toner are iron oxides such as magnetite, hematite, and ferrite; metals such as iron, cobalt, and nickel; alloys of the above-mentioned magnetic metals with the following metals such as aluminum, cobalt, copper, lead, magnesium, tin, zinc, antimony, beryllium, bismuth, cadmium, calcium, manganese, selenium, titanium, tungsten, and vanadium; and mixtures thereof.

It is preferable that the average particle diameter of the above-mentioned magnetic material be in the range of about 0.1 to 2 μm.

The amount of the magnetic material is preferably in the range of about 20 to 200 parts by weight, and more preferably in the range of 40 to 150 parts by weight, to 100 parts by weight of the binder resin for use in the toner composition.

In addition, the toner according to the present invention may further comprise other additives when necessary. Examples of the additives include lubricants such as Teflon and zinc stearate; abrasives such as cerium oxide and silicon carbide; fluidity-providing agents or caking inhibitors such as colloidal silica and aluminum oxide; electroconductivity-imparting agents such as carbon black and tin oxide; and a fixing-promoting agent such as a low-molecular weight polyolefin.

The toner according to the present invention can be used for a two-component developer in combination with a carrier. Any conventional carrier particles can be used for the preparation of the two-component developer of the present invention. For example, finely-divided particles of magnetic materials such as iron, ferrite, and nickel, and glass beads may be employed. These particles may be coated with a resin or a powder.

Examples of the resin with which the carrier particles are coated include styrene—acrylic copolymer resin, silicone resin, maleic resin, fluorine-containing resin, polyester resin, and epoxy resin. When the above-mentioned styrene—acrylic copolymer resin is used for coating the carrier particles, it is preferable to use the copolymer containing a styrene content in a range of 30 to 90 wt. %. When the carrier particles are coated with such a styrene—acrylic copolymer resin, the development performance can improve without curtailment of the life of the carrier. This is because the coating film of the carrier particles is not so hard that the peeling of the coating film can be prevented.

The resin film coated on the carrier particles may comprise an adhesion promoting agent, a curing agent, a lubricant, an electroconductive material, and a charge control agent.

When the previously mentioned toner of the present invention is used as a mono-component developer or two-component developer, the toner is set in a container. In general, a container filled with a toner, which is put on the market apart from an image forming apparatus, is incorporated into an image forming apparatus. The present invention provides a container holding therein the previously mentioned toner or two-component developer. The form of the container is not particularly limited. For instance, a bottle-shaped container or a cartridge type container may be used.

The present invention also provides an image forming apparatus provided with the container holding therein the above-mentioned toner or two-component developer according to the present invention. In this case, the image forming apparatus of the present invention may be designed to produce images by the electrophotographic process, and copying machines and printers are included.

Other features of this invention will become apparent in the course of the following description of exemplary embodiments, which are given for illustration of the invention and are not intended to be limiting thereof.

[Preparation of Carrier]

PREPARATION EXAMPLE 100 parts by weight of a silicone resin solution (trademark "RSR213", made by Dow Corning Toray Silicone Co., Ltd.), 1 part by weight of carbon black, and 2 parts by weight of a silane coupling agent were dispersed using a homomixer for 30 minutes to prepare a liquid for the formation of a resin film.

The thus obtained liquid for the formation of a resin film and 1000 parts by weight of ferrite particles were set in a fluidized bed coating apparatus, so that the ferrite particles were coated with the resin film. Thus, a carrier was prepared.

[Preparation of Toner]

Preparation Example 1

(Preparation of Non-linear Polyester Resin]

10 mol of fumaric acid, 4 mol of trimellitic acid anhydride, 6 mol of bisphenol A (2,2)propylene oxide, and 4 mol of bisphenol A (2,2)ethylene oxide were placed in a flask quipped with an agitator made of stainless steel, a condenser, a nitrogen gas introducing pipe, and a thermometer. With stirring the reaction mixture at 220° C. in a stream of nitrogen, a condensation polymerization was carried out to produce a non-linear polyester resin.

Preparation Example 2

(Preparation of Linear Polyester Resin]

8 mol of terephthalic acid, 3 mol of trimellitic acid anhydride, 6 mol of bisphenol A (2,2)propylene oxide, and 4 mol of bisphenol A (2,2)ethylene oxide were placed in a flask quipped with an agitator made of stainless steel, a condenser, a nitrogen gas introducing pipe, and a thermometer. With stirring the reaction mixture at 220° C. in a stream of nitrogen, a condensation polymerization was carried out to produce a linear polyester resin.

Preparation Example 3

(Preparation of Composite Resin]

20 mol of styrene and 5 mol of butyl methacrylate, serving as addition-polymerizable monomers, and 0.4 mol of t-butyl hydroperoxide as a polymerization initiator were mixed in a dropping funnel. Thus, a material for the addition polymerization was prepared.

A material for a condensation polymerization was prepared in the following manner. 10 mol of fumaric acid as a reactive monomer for both the addition polymerization and the condensation polymerization, 4 mol of trimellitic acid anhydride, 6 mol of bisphenol A (2,2)propylene oxide, and 4 mol of bisphenol A (2,2)ethylene oxide, serving as condensation-polymerizable monomers, and 60 mol of dibutyl tin oxide as a catalyst for esterification were placed in a flask quipped with an agitator made of stainless steel, a condenser, a nitrogen gas introducing pipe, and a thermometer. With stirring the mixture material for the condensation polymerization at 135° C. in a stream of nitrogen, the material for addition polymerization was added dropwise to the material for condensation polymerization through the dropping funnel over a period of 5 hours. After completion of the addition, the reaction mixture was maintained at 135° C. for 6 hours in order to age the reaction mixture. The temperature of the reaction mixture was raised to 220° C. to cause a reaction, whereby a composite resin was obtained.

Preparation Example 4

(Preparation of Metallic Compound of Oxycarboxylic Acid No. 1)

3 mol of 3,5-di-t-butyl salicylate, and sodium hydroxide were dissolved in water to prepare a first aqueous solution. With stirring the first aqueous solution at 60° C., an aqueous solution containing 1.5 mol of ferric chloride ($FeCl_2$) was added dropwise to the first aqueous solution, thereby obtaining crystals. The crystals were filtrated off, washed, dried, and pulverized, whereby a metallic compound of oxycarboxylic acid No. 1 with the following formula was obtained as a pale black powder.

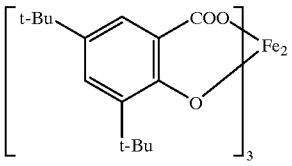

Preparation Example 5

(Preparation of Metallic Compound of Oxycarboxylic Acid No. 2)

4 mol of 3,5-di-t-butyl salicylate, and sodium hydroxide were dissolved in water to prepare a first aqueous solution. With stirring the first aqueous solution at 50° C., an aqueous solution containing 1 mol of zirconium chloride ($ZrCl_2$) was added dropwise to the first aqueous solution, thereby obtaining crystals. The crystals were filtrated off, washed, dried, and pulverized, whereby a metallic compound of oxycarboxylic acid No. 2 with the following formula was obtained as a white powder.

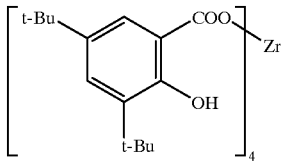

Preparation Example 6

(Preparation of Metallic Compound of Oxycarboxylic Acid No. 3)

5 mol of 3,5-di-t-butyl salicylate, and sodium hydroxide were dissolved in water to prepare a first aqueous solution. With stirring the first aqueous solution at 50° C., an aqueous solution containing 4 mol of oxyzirconium chloride ($ZrOCl_2.8H_2O$) was added dropwise to the first aqueous solution, thereby obtaining crystals. The crystals were filtrated off, washed, dried, and pulverized, whereby a metallic compound of oxycarboxylic acid No. 3 with the following formula was obtained as a white powder.

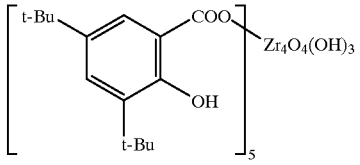

EXAMPLE 1

(Preparation of Toner)

| | Parts by weight |
|---|---|
| Non-linear polyester resin Prepared in Preparation Example 1 (hydroxyl number: 35 mgKOH/g, peak molecular weight: 6,000, and half peak width in molecular weight distribution: 70,000) | 100 |
| Low-molecular weight polypropylene (Trademark "VISCOL 550P", made by Sanyo Chemical Industries, Ltd.) | 3 |
| Carbon black (Trademark "MA-100", made by Mitsubishi Chemical Corporation) | 8 |
| Metallic compound of oxycarboxylic acid No. 1 (prepared in Preparation Example 4) | 1 |

A mixture of the above components was thoroughly stirred and blended in a Henschel mixer, and fused and kneaded in a roll mill at 130 to 140° C. for about 30 minutes. After the kneaded mixture was cooled to room temperature, the resultant mixture was coarsely ground by a hammer mill until the particle size reached 200 to 400 $\mu$m. The coarsely grounded particles were pulverized and classified using a commercially available pulverizing and classifying apparatus "SUPER SONIC JET MILL TYPE IDS-2" (trademark), made by Nippon Pneumatic Mfg. Co., Ltd.

The above-mentioned apparatus includes a pulverizer and a classifier. More specifically, the coarse particles were made collide with a target forcibly using a jet stream in the pulverizer so as to obtain finely pulverized particles. The particles thus pulverized are fed to the classifier where the particles are classified by centrifugal force using air flow forming vortex.

Thus, particles with a volume mean diameter of 10.0 μm were obtained. 99 parts by weight of the above-mentioned particles and 1.0 part by weight of hydrophobic silica (trademark "R972", made by Nippon Aerosil Co., Ltd.) were mixed and stirred using a Henschel mixer. The coarse particles were removed from the resultant mixture by passing the mixture through a screen, whereby a toner No. 1 according to the present invention was obtained.

2.5 parts by weight of the toner No. 1 and 97.5 parts by the carrier (prepared in Preparation Example) were mixed in a ball mill to provide a two-component developer No. 1 according to the present invention.

EXAMPLE 2

The procedure for preparation of the toner No. 1 in Example 1 was repeated except that the metallic compound of oxycarboxylic acid No. 1 for use in the toner composition in Example 1 was replaced by the metallic compound No. 3 prepared in Preparation Example 6. Thus, a toner No. 2 according to the present invention was obtained.

Using the above-mentioned toner No. 2, a two-component developer No. 2 was produced in the same manner as in Example 1.

EXAMPLE 3

The procedure for preparation of the toner No. 2 in Example 2 was repeated except that the low-molecular weight polypropylene (trademark "VISCOL 550 P", made by Sanyo Chemical Industries, Ltd.) for use in the toner composition in Example 2 was replaced by a carnauba wax free of free aliphatic acids (trademark "WA03", made by Toa Kasel Co., Ltd.). Thus, a toner No. 3 according to the present invention was obtained.

Using the above-mentioned toner No. 3, a two-component developer No. 3 was produced in the same manner as in Example 1.

EXAMPLE 4

| | Parts by weight |
|---|---|
| Non-linear polyester resin prepared in Preparation Example 1 (hydroxyl number: 35 mgKOH/g, peak molecular weight: 6,000, and halt peak width in molecular weight distribution: 70,000) | 50 |
| Linear polyester resin prepared in Preparation Example 2 (hydroxyl number; 40 mgKOH/g, peak molecular weight: 5,000, and halt peak width in molecular weight distribution; 10,000) | 35 |
| Composite resin prepared in Preparation Example 3 (peak molecular weight; 5,500, and half peak width in molecular weight distribution: 60,000) | 5 |
| Carnauba wax free of free aliphatic acids (trademark "WA03", made by Toa Kasei Co., Ltd.) | 3 |
| Carbon black (trademark "MA-100", made by Mitsubishi Chemical Corporation) | 8 |
| Metallic compound of oxycarboxylic acid No. 3 (prepared in Preparation Example 6) | 1 |

A mixture of the above components was thoroughly stirred and blended in a Henschel mixer, and fused and kneaded in a roll mill at 130 to 140° C. for about 30 minutes. After the kneaded mixture was cooled to room temperature, the resultant mixture was coarsely ground by a hammer mill until the particle size reached 200 to 400 μm. The coarsely grounded particles were pulverized and classified using the same commercially available pulverizing and classifying apparatus "SUPER SONIC JET MILL Type IDS-2" (trademark), made by Nippon Pneumatic Mfg, Co., Ltd., as employed in Example 1.

Thus, particles with a volume mean diameter of 10.0 μm were obtained.

When the molecular weight distribution of the obtained particles was measured by the GPC, the peak molecular weight was about 6,500 and the half peak width in molecular weight distribution was about 20,000.

99 parts by weight of the above-mentioned particles and 1.0 part by weight of hydrophobic silica (trademark "R972", made by Nippon Aerosil Co., Ltd.) were mixed and stirred using a Henschel mixer. The coarse particles were removed from the resultant mixture by passing the mixture through a screen, whereby a toner No. 4 according to the present invention was obtained.

2.5 parts by weight of the toner No. 4 and 97.5 parts by the carrier (prepared in Preparation Example) were mixed in a ball mill to provide a two-component developer No. 4 according to the present invention.

EXAMPLE 5

The procedure for preparation of the toner No. 4 in Example 4 was repeated except that the amount ratios among the non-linear polyester resin, the linear polyester resin, and the composite resin in the toner composition employed in Example 4 were changed to adjust the molecular weight distribution of the obtained toner. Thus, a toner No. 5 according to the present invention was obtained.

The peak molecular weight of the toner No. 5 was about 5,500 and the half peak width in molecular weight distribution was about 12,000.

Using the above-mentioned toner No. 5, a two-component developer No. 5 was produced in the same manner as in Example 1.

EXAMPLE 6

The procedure for preparation of the toner No. 5 in Example 5 was repeated except that the volume mean diameter of the particles obtained after pulverizing and classification was changed from 10.0 to 7.0 μm. Thus, a toner No. 6 according to the present invention was obtained.

Using the above-mentioned toner No. 6, a two-component developer No. 6 was produced in the same manner as in Example 1.

EXAMPLE 7

The procedure for preparation of the toner No. 5 in Example 5 was repeated except that the pulverizing step was carried out using a mechanical grinder. Thus, a toner No. 7 according to the present invention was obtained.

Using the above-mentioned toner No. 7, a two-component developer No. 7 was produced in the same manner as in Example 1.

COMPARATIVE EXAMPLE 1

The procedure for preparation of the toner No. 1 in Example 1 was repeated except that the hydroxyl number of the non-linear polyester resin used in the toner composition in Example 1 was changed from 35 to 28 mgKOH/g. Thus, a comparative toner No. 1 was obtained.

Using the above-mentioned comparative toner No. 1, a comparative two-component developer No. 1 was produced in the same manner as in Example 1.

COMPARATIVE EXAMPLE 2

The procedure for preparation of the toner No. 1 in Example 1 was repeated except that the hydroxyl number of the non-linear polyester resin used in the toner composition in Example 1 was changed from 35 to 71 mgKOH/g. Thus, a comparative toner No. 2 was obtained.

Using the above-mentioned comparative toner No. 2, a comparative two-component developer No. 2 was produced in the same manner as in Example 1.

COMPARATIVE EXAMPLE 3

The procedure for preparation of the toner No. 1 in Example 1 was repeated except that the metallic compound of oxycarboxylic acid No. 1 used in the toner composition in Example 1 was replaced by a zinc (II) compound of 3,5-di-t-butyl salicylic acid (trademark "BONTRON E-84" made by Orient Chemical Industries, Ltd.) Thus, a comparative toner No. 3 was obtained.

Using the above-mentioned comparative toner No. 3, a comparative two-component developer No. 3 was produced in the same manner as in Example 1.

COMPARATIVE EXAMPLE 4

The procedure for preparation of the toner No. 1 in Example 1 was repeated except that the metallic compound of oxycarboxylic acid No. 1 used in the toner composition in Example 1 was replaced by an iron-containing azo complex compound (trademark "T77" made by Hodogaya Chemical Co., Ltd.) Thus, a comparative toner No. 4 was obtained.

Using the above-mentioned comparative toner No. 4, a comparative two-component developer No. 4 was produced in the same manner as in Example 1.

The toners No. 1 to No. 7 according to the present invention and the comparative toners No. 1 to No. 4 were evaluated by the following methods:

(1) Charging Rise-up Properties

Each toner was stirred in a ball mill. One minute later, the charge quantity (A1) of the toner was measured by the blow-off method. After the toner was stirred for 10 minutes, the charge quantity (A2) was measured in a similar manner. The charging rise-up properties of each toner were expressed in accordance with the following formula:

$$\text{Charging rise-up Properties}=(A2-A1)/9$$

The evaluation of the charging rise-up properties was carried out on five levels. The smaller the value obtained by the above formula, the better the charging rise-up properties.

The results are shown in TABLE 1. The evaluation criterion is as follows:

5: less than 0.1

4: 0.1 or more and less than 0.25

3: 0.25 or more and less than 0.5

2: 0.5 or more and less than 0.75

1: 0.75 or more (2) Environmental Stability

Under the circumstances of low temperature and low humidity, i.e., 10° C. 20% RH, the charge quantity (Q1) of toner was measured by the blow off method. Under the circumstances of high temperature and high humidity, i.e., 30° C. and 80% RH, the charge quantity (Q2) of toner was also measured by the blow off method.

The environmental stability of each toner was expressed by an environmental variable in accordance with the following formula:

$$\text{Environmental Variable (\%)}=(Q1-Q2)/Q1\times 100$$

The evaluation of the environmental stability was carried out on five levels. The smaller the value of the environmental variable, the higher the environmental stability.

The results are also shown in TABLE 1. The evaluation criterion is as follows:

5: less than 50%

4: 50% or more and less than 60%

3: 60% or more and less than 70%

2: 70% or more and less than 80%

1: 80% or more (3) Toner Fixing Properties

Each two-component developer was set in a commercially available copying machine "MF-200" (trademark), made by Ricoh Company, Ltd., equipped with an image fixing unit having a TEFLON image fixing roller. The image fixing unit was modified so that the surface temperature of the TEFLON image fixing roller was variously changed. With the surface temperature set to a predetermined temperature, toner images were produced on three sheets of paper (trademark "TYPE 6200", made by Ricoh Company, Ltd.). Thus, the hot-offset occurrence temperature and the cold-offset occurrence temperature were obtained. For obtaining the hot-offset occurrence temperature, a toner-image-bearing paper was allowed to pass through the TEFLON image fixing roller at a linear velocity of 50 mm/sec under a pressure of 2.0 kgf/cm$^2$, with a nip width being set to 4.5 mm. For obtaining the cold-offset occurrence temperature, a toner-image-bearing paper was allowed to pass through the TEFLON image fixing roller at a linear velocity of 140 mm/sec under a pressure of 1.2 kgf/cm$^2$, with a nip width being set to 3 mm.

The evaluation of the anti-hot-offset performance was carried out on five levels according to the hot-offset occurrence temperature. The higher the hot-offset occurrence temperature, the better the anti-hot-offset performance.

The results are also shown in TABLE 1. The evaluation criterion is as follows:

5: hot-offset occurrence temp. ≧201° C.

4: 200° C.≧hot-offset occurrence temp.≧191° C.

3: 190° C.≧hot-offset occurrence temp.≧181° C.

2: 180° C.≧hot-offset occurrence temp.≧171° C.

1: 170° C.≧hot-offset occurrence temp.

The evaluation of the anti-cold-offset performance was carried out on five levels according to the cold-offset occurrence temperature. The lower the cold-offset occurrence temperature, the better the anti-cold-offset performance.

The results are also shown in TABLE 1. The evaluation criterion is as follows:

5: cold-offset temp.<125° C.

4: 125° C.≦cold-offset occurrence temp.<134° C.

3: 135° C.≦cold-offset occurrence temp.<144° C.

2: 145° C.≦cold-offset occurrence temp.<154°

1: 155° C.≦cold-offset occurrence temp.

(4) Grindability

Each toner composition was crushed to have a volume mean diameter of 1 mm or less. These crushed particles were fed into the above-mentioned commercially available pulverizing and classifying apparatus (trademark "SUPER SONIC JET MILL IDS-2", made by Nippon Pneumatic Mfg. Co., Ltd.) under the same conditions. The amount of crushed particles that were fed into the apparatus to obtain a predetermined particle size was measured per unit hour.

The evaluation of the grindability of toner was carried out on five levels. The more the amount of toner particles, the better the grindability of the toner.

The results are also shown in TABLE 1. The evaluation criterion is as follows:

5: 7 kg of more

4: 5 kg or more and less than 7 kg

3: 3 kg or more and less than 5 kg

2: 2 kg or more and less than 3 kg

1: less than 2 kg (5) Heat-resistant Shelf Stability

Each toner weighing 20 g was placed in a 20 ml-glass bottle, and allowed to stand in a temperature-controlled bath of 60° C. for 4 hours. Thereafter, each toner was subjected to a penetration test according to Japanese Industrial Standard K 2235-1991 to obtain a penetration.

The evaluation of the reproducibility of thin line images was carried out on five levels by visual observation.

The results are also shown in TABLE 1. The evaluation criterion is as follows:

5: excellent

4: good

3: normal

2: poor

1: very poor (7) Image Transfer Performance

Each two-component developer was set in the commercially available copying machine "MF-200" (trademark), made by Ricoh Company, Ltd., to produce a character chart on postal cards. The Ming-style type characters with a character size of 10 points were output at a recording density of 19 characters per line. The number of characters with a non-transferred spot was counted.

The evaluation of the image transfer performance was relatively carried out on three levels according to the number of characters with a non-transferred spot.

The results are also shown in TABLE 1. The evaluation criterion is as follows:

3: excellent

2: good

1: poor

TABLE 1

| | | | | | Toner Fixing Properties | | | | | |
|---|---|---|---|---|---|---|---|---|---|---|
| | Volume Mean Diameter (μm) | Average Circularity | Charging Rise-up Properties (5-1) | Environmental Stability (5-1) | Anti-hot-offset performance (5-1) | Anti-cold-offset performance (5-1) | Grindability (5-1) | Heat-resistant Shelf Stability (4-1) | Reproducibility of Thin Line Image (5-1) | Image transfer Performance (3-1) |
| Ex. 1 | 10.0 | 0.930 | 5 | 4 | 4 | 4 | 4 | 4 | 3 | 2 |
| Ex. 2 | 10.0 | 0.931 | 5 | 4 | 4 | 4 | 4 | 4 | 3 | 2 |
| Ex. 3 | 10.0 | 0.929 | 5 | 4 | 5 | 4 | 4 | 4 | 3 | 2 |
| Ex. 4 | 10.0 | 0.931 | 5 | 4 | 5 | 5~4 | 5 | 5 | 3 | 2 |
| Ex. 5 | 10.0 | 0.930 | 5 | 4 | 5 | 5 | 5 | 5 | 3 | 2 |
| Ex. 6 | 7.0 | 0.938 | 5 | 4 | 5 | 5 | 4 | 4 | 5 | 2 |
| Ex. 7 | 7.0 | 0.950 | 5 | 4 | 5 | 5 | 4 | 4 | 5 | 3 |
| Comp Ex. 1 | 10.0 | 0.931 | 4 | 4 | 2 | 4 | 4 | 4 | 3 | 2 |
| Comp. Ex. 2 | 10.0 | 0.932 | 5 | 1 | 4 | 4 | 4 | 4 | 3 | 2 |
| Comp. Ex. 3 | 10.0 | 0.930 | 3 | 3 | 2 | 4 | 4 | 4 | 3 | 2 |
| Comp. Ex. 4 | 10.0 | 0.932 | 3 | 3 | 1 | 4 | 4 | 4 | 3 | 2 |

The evaluation of the heat-resistant shelf stability of toner was carried out on four levels according to the penetration. The more the penetration value, the better the heat-resistant shelf stability of the toner.

The results are also shown in TABLE 1. The evaluation criterion is as follows:

4: penetration≧10 mm

3: 9.9 mm≧penetration≧5 mm

2: 4.9 mm≧penetration≧3 mm

1: 2.9 mm≧penetration≧0 mm (6) Reproducibility of Thin Line Image

Each two-component developer was set in the commercially available copying machine "MF-200" (trademark), made by Ricoh Company, Ltd., to produce thin line images.

As previously explained, the toner of the present invention exhibits satisfactory charging rise-up properties and environmental stability in the charging characteristics, and anti-hot-offset performance.

Further, the anti-cold-offset performance can be improved and high productivity can be obtained. In addition, the heat-resistant shelf stability of the toner is excellent, and high quality toner images can be obtained.

Japanese Patent Application No. 2000-097743 filed Mar. 31, 2000 is hereby incorporated by reference.

What is claimed is:

1. A toner for developing electrostatic latent images, comprising:

a coloring agent, a release agent, a binder resin comprising a non-linear polyester resin with a hydroxyl number of 30 to 70 mgKOH/g, and a metallic compound of an aromatic oxycarboxylic acid with a central metal having a valence of 3 or more, wherein said binder resin further comprises:

a linear polyester resin and a composite resin comprising a polyester resin and a vinyl resin, wherein said composite resin is prepared by parallel reaction of (1) a condensation polymerization of a condensation-polymerizable monomer to prepare said polyester resin and (2) an addition polymerization of an addition-polymerizable monomer to prepare said vinyl resin in the same reactor;

and wherein said toner exhibits a peak molecular weight within a range of 1,000 to 10,000 and has a half peak width of 15,000 or less when a molecular weight distribution is determined from a soluble content in tetrahydrofuran by gel permeation chromatography.

2. The toner as claimed in claim 1, wherein said metallic compound of said aromatic oxycarboxylic acid has a formula represented by:

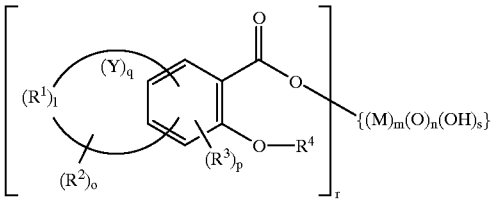

wherein Y represents a cyclic structure of saturated or unsaturated bonds; $R^1$, which represents a moiety included in said cyclic structure of Y, is a quaternary carbon, methine, or methylene, and $R^1$ may include a hetero atom; $R^2$ and $R^3$ are each independently an alkyl group, an alkenyl group, an alkoxyl group, a substituted or unsubstituted aryl group, an aryloxy group, an aralkyl group, an aralkyloxy group, a halogen atom, a hydrogen atom, hydroxyl group, a substituted or unsubstituted amino group, carboxyl group, carbonyl group, nitro group, nitroso group, sulfonyl group, or cyano group; $R^4$ is a hydrogen atom or an alkyl group; l is an integer of 0, or 3 to 12; m is an integer of 1 to 20; n is an integer of 0 to 20; o is an integer of 0 to 4; p is an integer of 0 to 4; q is an integer of 0 to 3; r is an integer of 1 to 20; s is an integer of 0 to 20; and M is a metal having a valence of 3 or more.

3. The toner as claimed in claim 2, wherein Y represents a cyclic structure of saturated bonds.

4. The toner as claimed in claim 2, wherein Y represents a cyclic structure of unsaturated bonds.

5. The toner as claimed in claim 2, wherein $R^1$ is a quaternary carbon.

6. The toner as claimed in claim 2, wherein $R^1$ is methine.

7. The toner as claimed in claim 2, wherein $R^1$ is methylene.

8. The toner as claimed in claim 2, wherein $R^1$ includes a hetero atom.

9. The toner as claimed in claim 2, wherein $R^4$ is a hydrogen atom.

10. The toner as claimed in claim 2, wherein $R^4$ is an alkyl group.

11. The toner as claimed in claim 2, wherein l is 0.

12. The toner as claimed in claim 2, wherein l is an integer of 3 to 12.

13. The toner as claimed in claim 1, wherein said central metal of said metallic compound is iron (Fe).

14. The toner as claimed in claim 1, wherein said central metal of said metallic compound is Zr.

15. The toner as claimed in claim 1, wherein said release agent comprises a carnauba wax free of free aliphatic acids.

16. The toner as claimed in claim 1, further comprising a metal salt of a monoazo dye as a charge control agent.

17. The toner as claimed in claim 1, wherein said toner has toner particles with a volume mean diameter of 4 to 8 $\mu$m.

18. The toner as claimed in claim 1, wherein said toner has toner particles with an average circularity of 0.940 or more.

19. The toner as claimed in claim 1, wherein the release agent is present in an amount ranging from 1 to 20 parts by weight based on 100 parts by weight of the binder resin.

20. The toner as claimed in claim 1, wherein the release agent is present in an amount ranging from 3 to 10 parts by weight based on 100 parts by weight of the binder resin.

21. The toner as claimed in claim 1, wherein the release agent is carnauba wax in a microcrystalline state with an acid value of 5 or less.

22. A two-component developer comprising a toner and a carrier, said toner comprising:

a coloring agent, a release agent, a binder resin comprising a non-linear polyester resin with a hydroxyl number of 30 to 70 mgKOH/g, and a metallic compound of an aromatic oxycarboxylic acid with a central metal having a valence of 3 or more, wherein said binder resin further comprises:

a linear polyester resin and a composite resin comprising a polyester resin and a vinyl resin, wherein said composite resin is prepared by parallel reaction of (1) a condensation polymerization of a condensation-polymerizable monomer to prepare said polyester resin and (2) an addition polymerization of an addition-polymerizable monomer to prepare said vinyl resin in the same reactor;

and wherein said toner exhibits a peak molecular weight within a range of 1,000 to 10,000 and has a half peak width of 15,000 or less when a molecular weight distribution is determined from a soluble content in tetrahydrofuran by gel permeation chromatography.

23. The two-component developer as claimed in claim 22, wherein said metallic compound of said aromatic oxycarboxylic acid has a formula represented by:

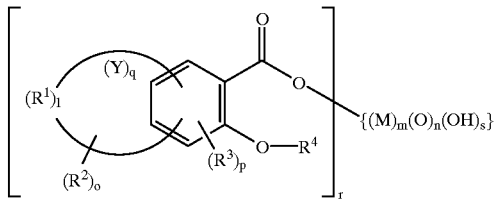

wherein Y represents a cyclic structure of saturated or unsaturated bonds; $R^1$, which represents a moiety included in said cyclic structure of Y, is a quaternary carbon, methine, or methylene, and $R^1$ may include a hetero atom; $R^2$ and $R^3$ are each independently an alkyl group, an alkenyl group, an alkoxyl group, a substituted or unsubstituted aryl group, an aryloxy group, an aralkyl group, an aralkyloxy group, a halogen atom, a hydrogen atom, hydroxyl group, a substituted or unsubstituted amino group, carboxyl group, carbonyl group, nitro group, nitroso group, sulfonyl group, or cyano group; $R^4$ is a hydrogen atom or an alkyl group; l is an integer of 0, or 3 to 12; m is an integer of 1 to 20; n is an integer of 0 to 20; o is an integer of 0 to 4; p is an integer of 0 to 4; q is an integer of 0 to 3; r is an integer of 1 to 20; s is an integer of 0 to 20; and M is a metal having a valence of 3 or more.

24. The toner as claimed in claim 23, wherein Y represents a cyclic structure of saturated bonds.

25. The toner as claimed in claim 23, wherein Y represents a cyclic structure of unsaturated bonds.

26. The toner as claimed in claim 23, wherein $R^1$ is a quaternary carbon.

27. The toner as claimed in claim 23, wherein $R^1$ is a methine.

28. The toner as claimed in claim 23, wherein $R^1$ is a methylene.

29. The toner as claimed in claim 23, wherein $R^1$ includes a hetero atom.

30. The toner as claimed in claim 23, wherein $R^4$ is a hydrogen atom.

31. The toner as claimed in claim 23, wherein $R^4$ is an alkyl group.

32. The toner as claimed in claim 23, wherein l is 0.

33. The toner as claimed in claim 23, wherein l is an integer of 3 to 12.

34. The two-component developer as claimed in claim 11, wherein said central metal of said metallic compound is iron (Fe).

35. The two-component developer as claimed in claim 22, wherein said central metal of said metallic compound is Zr.

36. The two-component developer as claimed in claim 11, wherein said release agent comprises a carnauba wax free of free aliphatic acids.

37. The two-component developer as claimed in claim 22, wherein said toner further comprises a metal salt of a monoazo dye as a charge control agent.

38. The two-component developer as claimed in claim 22, wherein said toner has toner particles with a volume mean diameter of 4 to 8 $\mu$m.

39. The two-component developer as claimed in claim 22, wherein said toner has toner particles with an average circularity of 0.940 or more.

40. The toner as claimed in claim 22, wherein the release agent is present in an amount ranging from 1 to 20 parts by weight based on 100 parts by weight of the binder resin.

41. The toner as claimed in claim 22, wherein the release agent is present in an amount ranging from 3 to 10 parts by weight based on 100 parts by weight of the binder resin.

42. The toner as claimed in claim 22, wherein the release agent is carnauba wax in a microcrystalline state with an acid value of 5 or less.

* * * * *